United States Patent [19]

Schaeper et al.

[11] Patent Number: 4,458,876

[45] Date of Patent: Jul. 10, 1984

[54] ANNULAR BLOWOUT PREVENTER

[75] Inventors: Gary R. Schaeper; Bolie C. Williams, III, both of Houston, Tex.

[73] Assignee: Ventre Corporation, Mt. Clemens, Mich.

[21] Appl. No.: 419,081

[22] Filed: Sep. 16, 1982

[51] Int. Cl.[3] ..... E21B 33/06

[52] U.S. Cl. ..... 251/1 B; 251/212

[58] Field of Search ..... 251/1 B, 1 R, 212

[56] References Cited

U.S. PATENT DOCUMENTS

| | | | |
|---|---|---|---|
| 3,915,424 | 10/1975 | LeRouax | 251/1 B |
| 3,915,425 | 10/1975 | LeRouax | 251/1 B |
| 4,099,699 | 7/1978 | Allen | 251/1 B |

*Primary Examiner*—Martin P. Schwadron
*Assistant Examiner*—Sheri Novack
*Attorney, Agent, or Firm*—Harness, Dickey & Pierce

[57] ABSTRACT

An annular blowout preventer having a body with a central bore, a piston chamber, and a packer chamber surrounding the central bore, a piston in the piston chamber, an annular packer in the packer chamber, the annular packer including a resilient annulus and a plurality of metal irising inserts embedded in the annulus and having upper triangular plates, lower triangular plates, a stem connecting the plates and means interconnecting adjoining plates to avoid inadvertent separation of one or more of said inserts, the annular packer moving between open and closed positions responsive to movement of the piston.

12 Claims, 12 Drawing Figures

ANNULAR BLOWOUT PREVENTER

BACKGROUND

Annular blowout preventers are used in drilling wells and are designed to provide a full size opening during operations and when actuated to close on the structure extending therethrough or if no structure is present to close on itself, to prevent a blowout and thus control the well.

In prior blowout preventers, metal inserts have been used in the top surface of the annular packer to prevent extrusion and damage to the packer. Some prior metal inserts have been adapted to have an irising action, i.e., the inserts have a compound motion including a pivotal and a radial motion. Two examples of this type of blowout preventer packer are shown in U.S. Pat. Nos. 3,572,627 and 4,099,699. Other prior structures have used such metal inserts in annular blowout preventer packers and their motion is a simple radial motion. Two examples of this latter type are shown in U.S. Pat. Nos. 3,897,038 and 3,915,424.

One problem which has been encontered with these prior art annular blowout preventers is that when the annular packer deteriorates as a result of exposure to oil base muds the metal inserts can drop into the well bore and if they are hard cast alloy steel they will junk the hole causing drilling to be directed around them by a whipstock or other suitable means.

SUMMARY

The present invention relates to an improved annular blowout preventer and to the improved annular blowout preventer packer with metal inserts used to add support to the annular resilient packer. The improved blowout preventer of the present invention includes an annular body having a central bore therethrough, a piston chamber and an annular packer chamber surrounding the central bore, an annular piston in said piston chamber, an annular resilient packer in said packer chamber, means connecting from said piston to force said packer inward responsive to piston movement in one direction and to allow the packer to relax into the packer chamber responsive to piston movement in the other direction, said annular packer including a resilient annulus and a plurality of metal inserts embedded in said resilient annulus, each of said inserts including an upper and a lower triangular-shaped plate, each plate having a projection extending outward on one side and a recess on the opposite side whereby the projection engages within the recess of the adjacent plate and the recess receives a projection of the other adjacent plate and a stem being integral and extending between the upper plate and the lower plate.

An object of the present invention is to provide an improved annular blowout preventer which will not junk the well bore even when the resilient packer deteriorates.

A further object is to provide an improved annular blowout preventer with interconnected irising upper and lower metal insert plates which support the packer without limiting its opening and closing moment.

Another object is to provide an improved packer for an annular blowout preventer having irising metal support inserts which in their movement are interconnected to prevent their falling in the well bore and to provide uniform support for the resilient portion of the packer without restricting its movement or damaging the resilient portions associated therewith.

BRIEF DESCRIPTION OF THE DRAWINGS

These and other objects and advantages of the present invention are hereinafter set forth and explained with respect to the drawings wherein.

DESCRIPTION OF THE PREFERRED EMBODIMENTS

Figure 1:
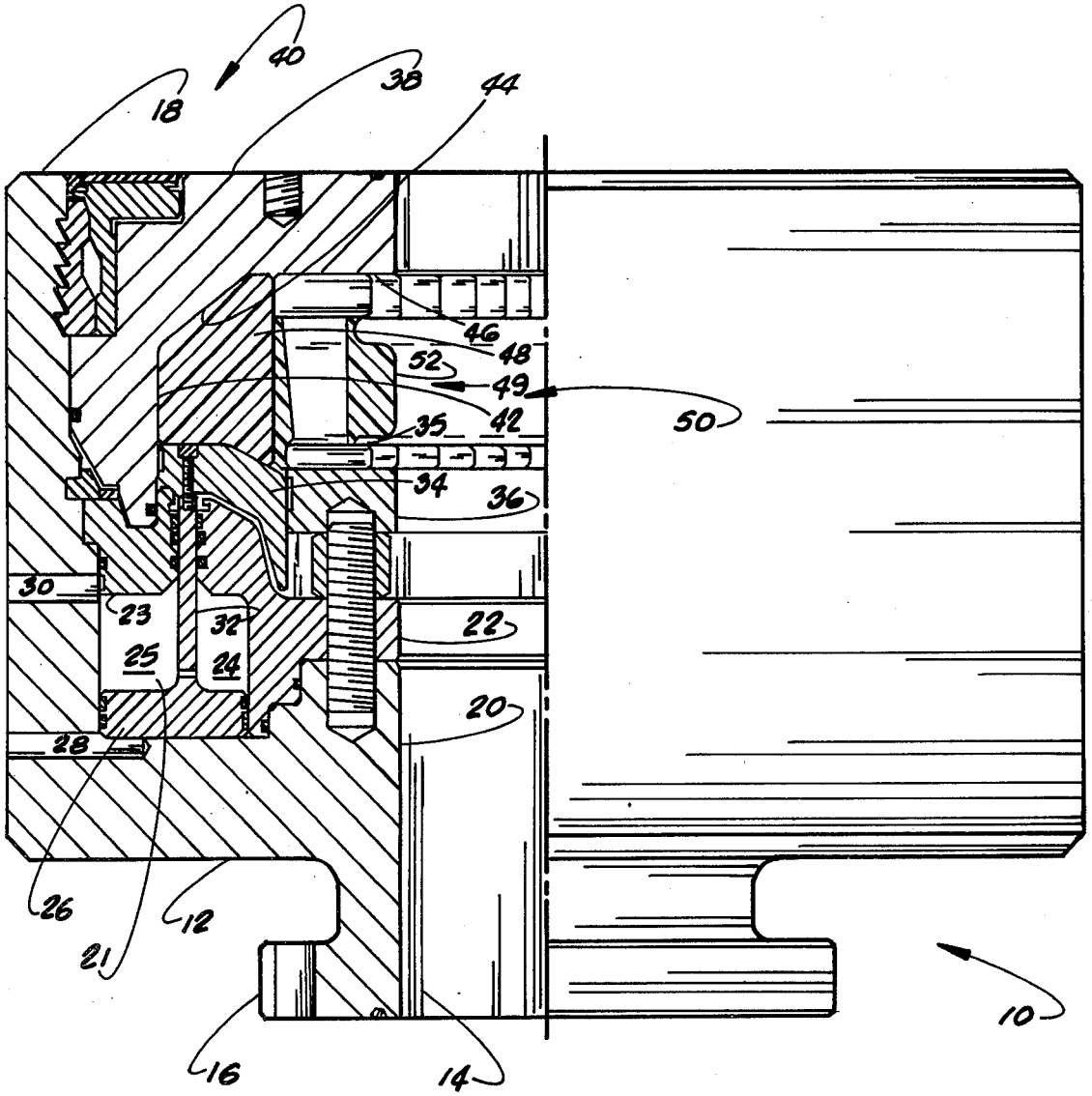
FIG. 1 is an elevation view, partly in section, of the improved annular blowout preventer of the present invention in open position.
Figure 2:
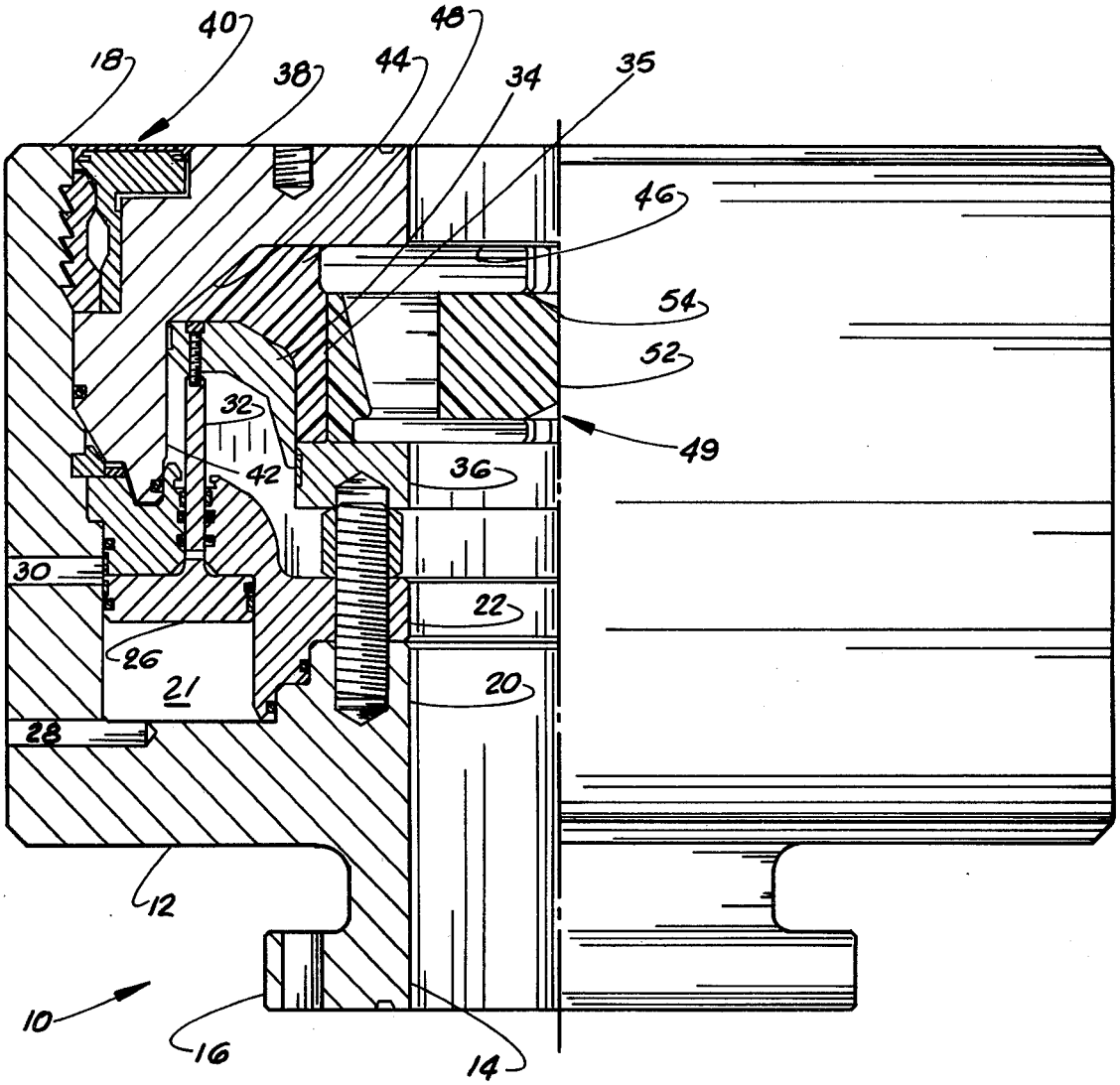
FIG. 2 is a similar view with the preventer shown in closed position.

Improved annular blowout preventer 10 of the present invention is shown in FIG. 1 in open position and in FIG. 2 in closed position. It includes annular body 12 having a central bore 14, flange 16 for connection to a stack, outer upstanding rim 18 and inner rim 20 to which annular plate 22 is secured to form inner portion 24 of piston chamber 26. Cylinder head 23 is mounted in outer upstanding rim 18 to form outer portion 25 of piston chamber 21. Annular piston 26 is positioned in chamber 21 for movement therein responsive to fluid pressure delivered therein through ports 28 and 30. Annular piston rod 32 connects from piston 26 through plate 22 and head 23 to annular wedge actuator 34 having upwardly and outwardly tapered surface 35. Ring 36 is mounted on plate 22 and ring 38 is secured within rim 18 by suitable securing means 40. The interior of ring 38 has a generally cylindrical surface 42 at its lower end and extends upward to the inward and upward tapered surface 44 and then to flat surface 46. Annular packer chamber 49 is formed within surface 42 and between surface 46 and the upper surface of ring 36 and annular wedge actuator 34. Annular packer 50 is positioned in packer chamber 49 within resilient annular actuator ring 48. Resilient actuator ring 48 is positioned against surface 42 and between the upper end of wedge actuator 34 and tapered surface 44.

Figure 3:
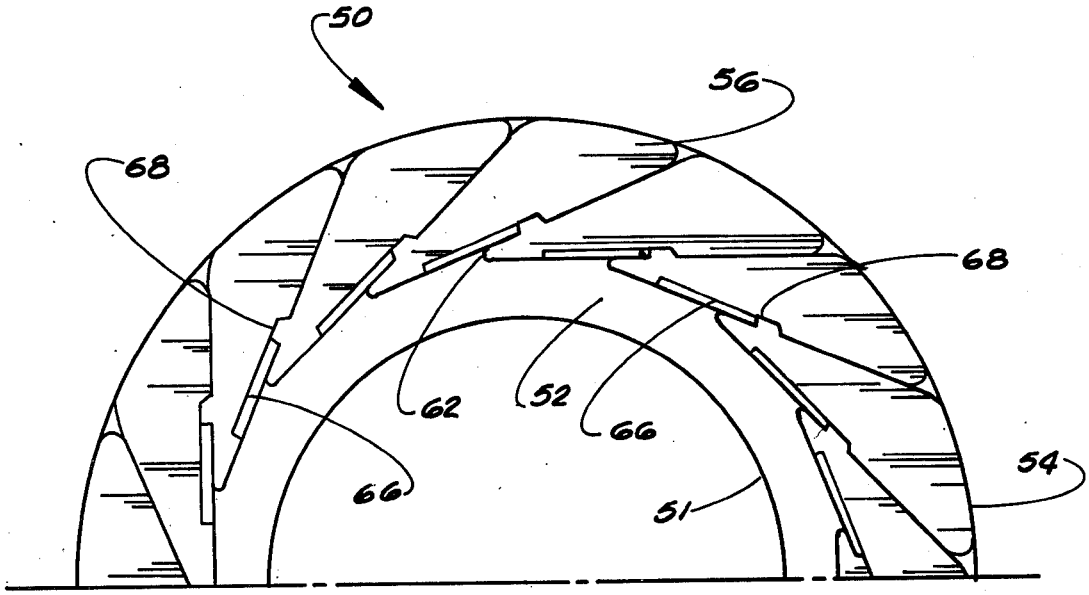
FIG. 3 is a plan view of the annular packer in open position.
Figure 4:
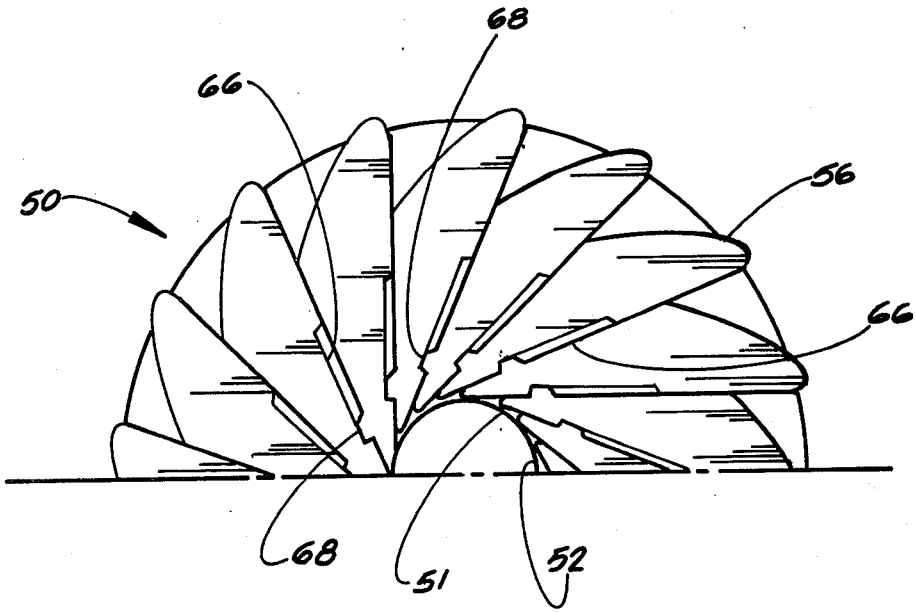
FIG. 4 is a plan view of the annular packer in closed position.
Figure 5:
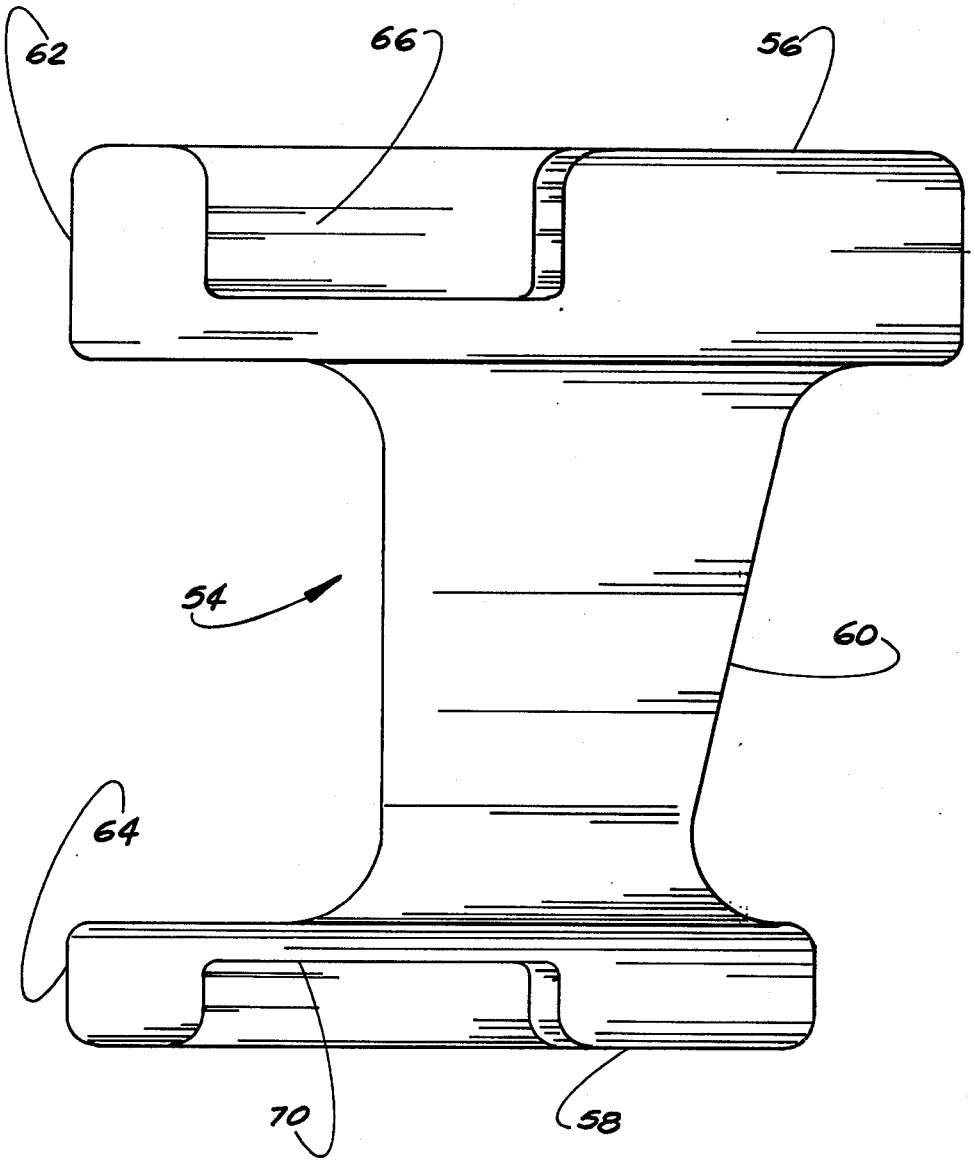
FIG. 5 is an elevation view of the improved packer insert of the present invention.
Figure 6:
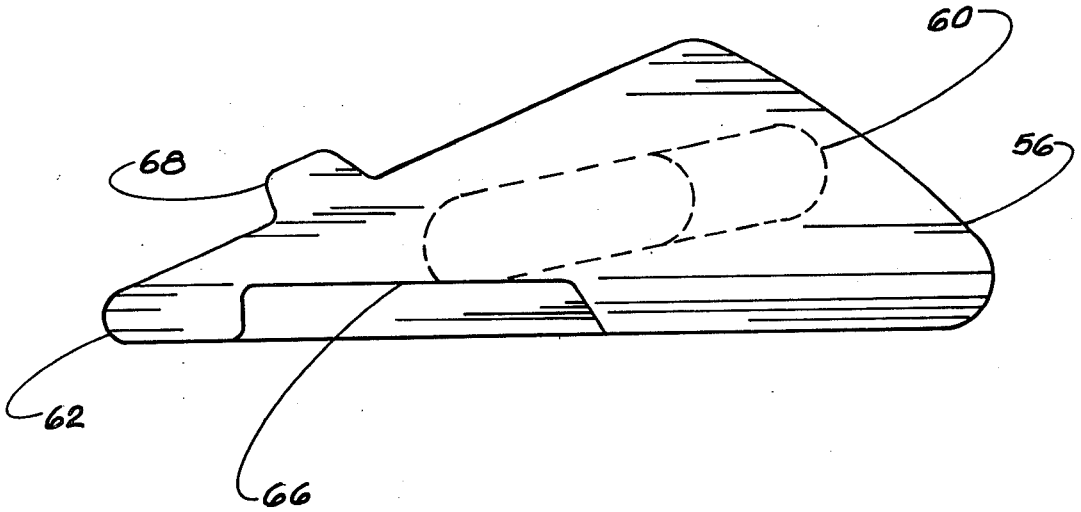
FIG. 6 is a top view of the insert shown in FIG. 5.
Figure 7:
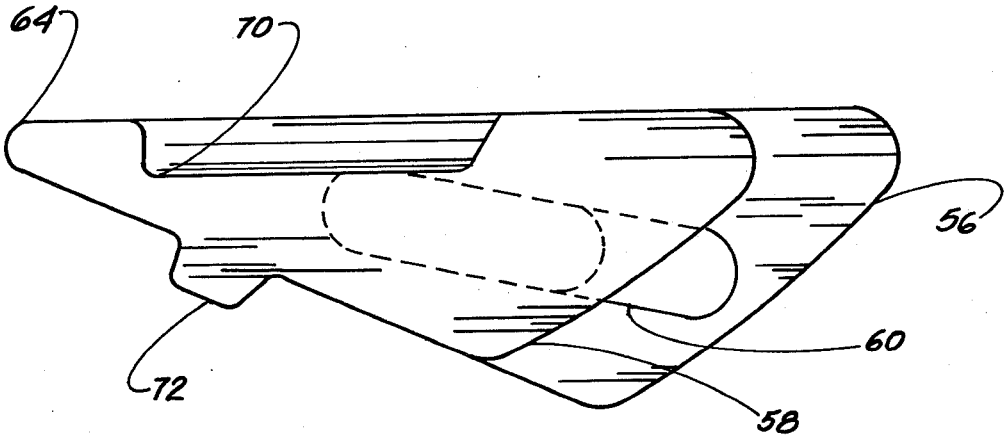
FIG. 7 is a bottom view of the insert shown in FIG. 5.
Figure 8:
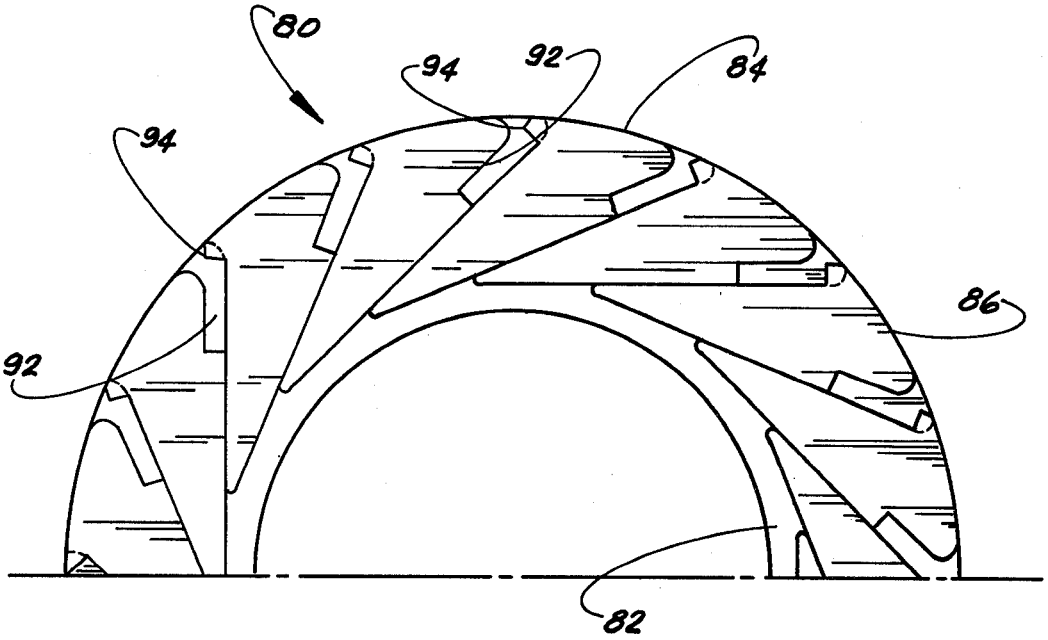
FIG. 8 is a plan view of a modified annular packer in open position.
Figure 9:
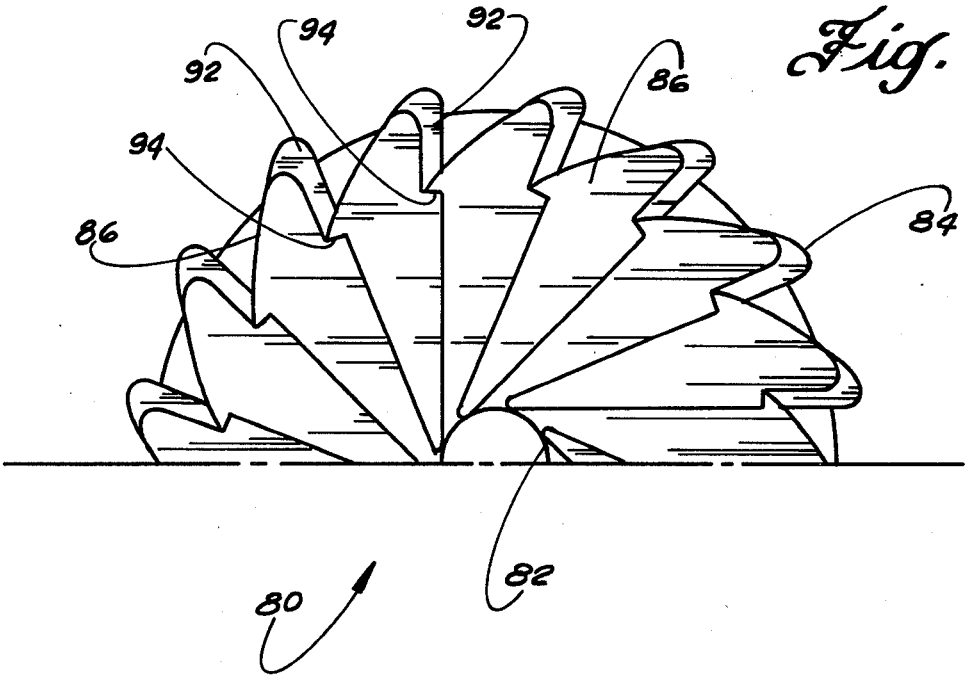
FIG. 9 is a plan view of the packer of FIG. 8 in closed position.
Figure 10:
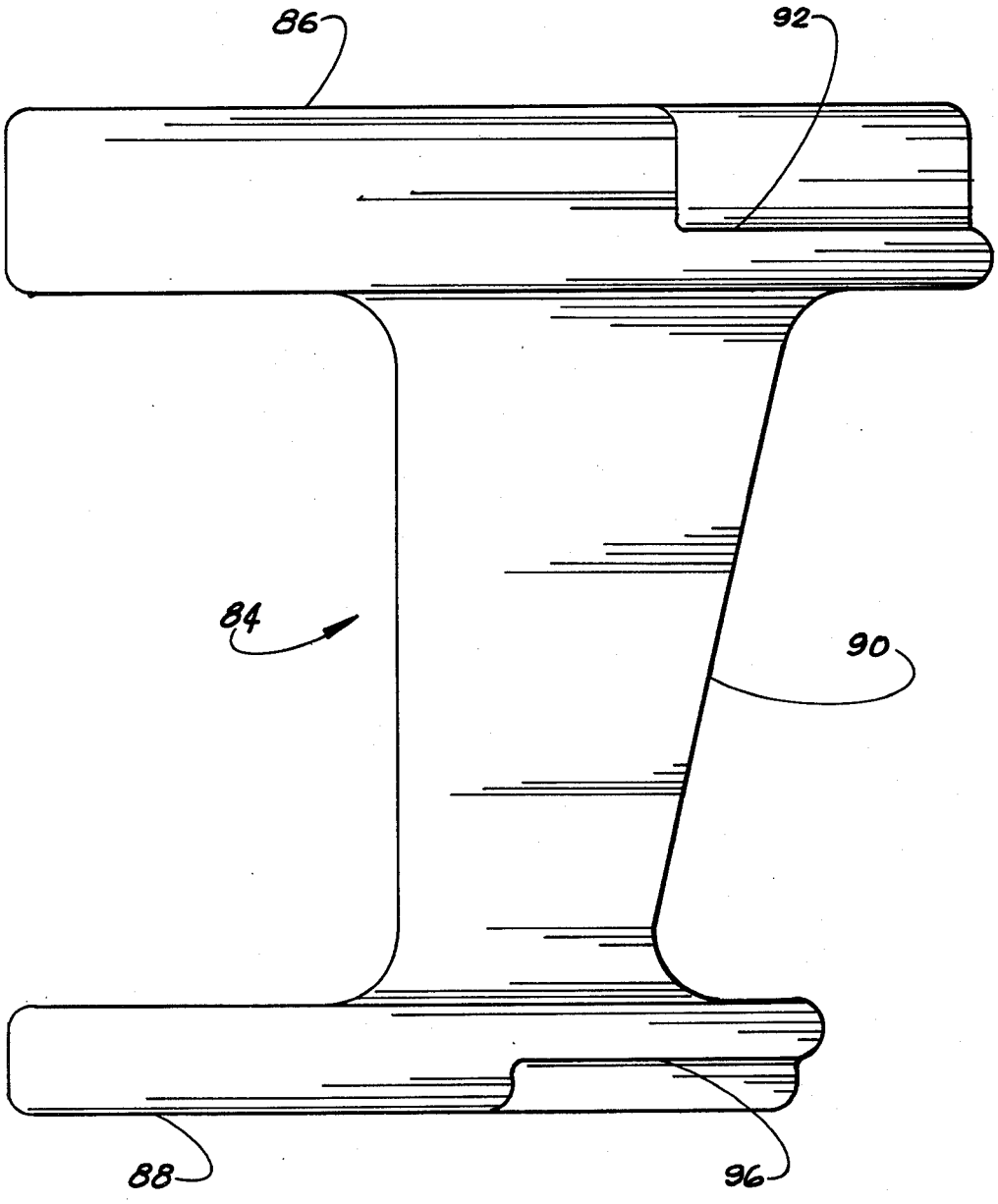
FIG. 10 is an elevation view of the insert of the modified packer.
Figure 11:
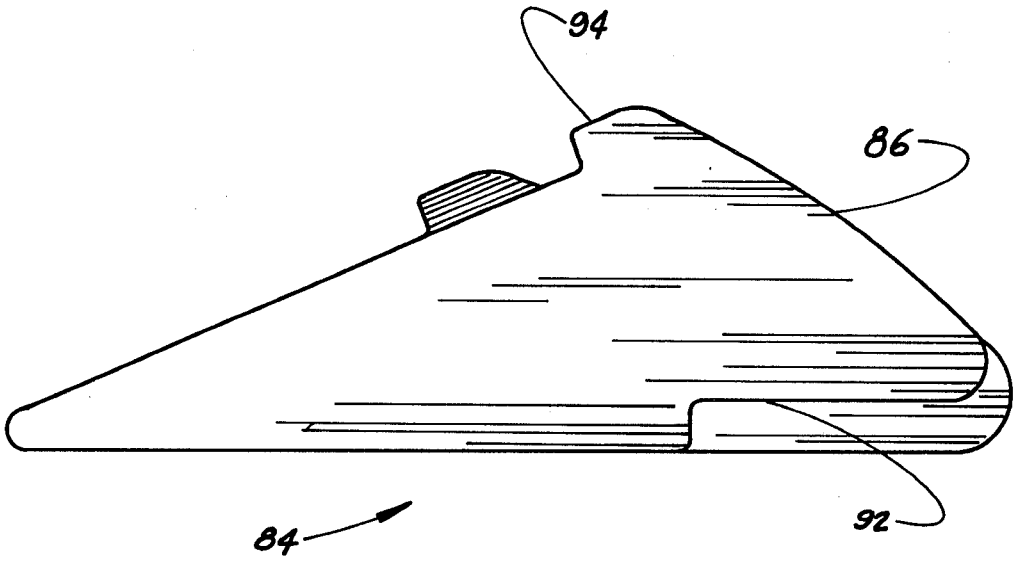
FIG. 11 is a top view of the insert shown in FIG. 10.
Figure 12:
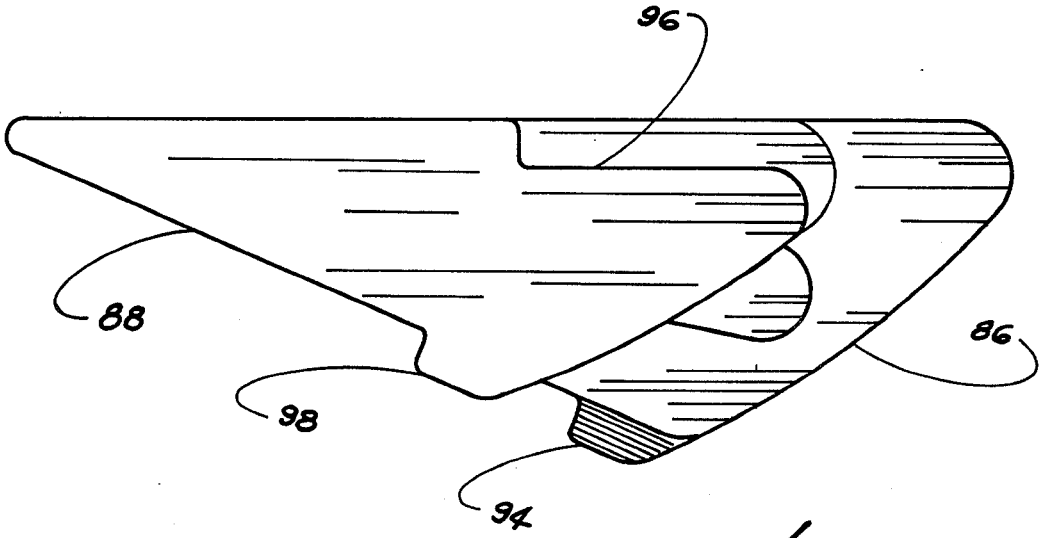
FIG. 12 is a bottom view of the insert shown in FIG. 10.

Improved annular packer 50 includes resilient annulus 52 and a plurality of irising metal inserts 54 embedded in the resilient annulus 52 as hereinafter described. Each insert 54 includes upper triangular shaped plate 56, lower triangular shaped plate 58 and stem 60 between plates 56 and 58 and integral therewith, or otherwise secured to such plates. Plates 56 and 58 are positioned with their acute or sharp ends 62 and 64 facing around and near the inner periphery 51 of resilient annulus 52 as shown in FIG. 3. Upper plate 56 has recess 66 on one side facing upward and starting a short distance from end 62 and extending back to a point to the rear of the mid point of that side. Projection 68 extends outward from the side of plate 56 opposite recess 66 and is positioned to be in the outer portion of the recess 66 in the adjacent insert plate 56 when annular packer 50 is in its open position as shown in FIGS. 1 and 3. Also projection 68 is positioned in the inner end of recess 66 of the adjacent insert plate 56 when annular packer 50 is in its closed position as shown in FIGS. 2 and 4. Plate 58 is slightly smaller than plate 56 and is similarly positioned but is the reverse image with respect to plate 56 since it is generally aligned therewith as can best be seen in FIG. 7. Plate 58 includes a side recess 70 facing downward and projection 72 which is positioned to ride in the recess 70 of the adjacent insert plate 58 in the same manner as described above in relation to plate 56. It is preferred that inserts 54 be integrally cast alloy steel.

Recesses 66 and 70 are shown facing away from resilient annulus 52, to ensure that the material of resilient annulus 52 is excluded from the recesses. The preferred position of the projections and recesses is as shown in FIGS. 1 to 7. In this position the irising action of inserts 54 does not damage resilient annulus 52 nor does the resilient material prevent free movement of the projections in their respective recesses.

The closing of annular packer 50 is accomplished by supplying pressure below annular piston 26 so that it moves upward and such motion moves annular wedge actuator 34 upward against resilient annular actuator ring 48. The upper tapered surface 35 on actuator 34 and tapered surface 44 on ring 38 urge actuator ring 48 inward which moves annular packer 50 to its closed position shown in FIGS. 2 and 4. The inner portion of resilient annulus 52 is forced inward and such movement pivots inserts 54 to move ends 62 and 64 a greater radial distance than the radial inward movement of the outer portion of plates 56 and 58. In the closed position projections 68 and 72 are positioned in the inner area of recesses 66 and 70. In either open or closed position inserts 54 are so interengaged that even the deterioration of substantial portions or all of resilient annulus 52 does not free them sufficiently to allow them to drop through bore 14 into the well bore below. Also, the movement of inserts 54 does not cause any pinching or damage to resilient actuator ring 48.

A modified form of the annular packer of the present invention is shown as packer 80 in FIGS. 8 to 12. Packer 80 includes resilient annulus 82 and a plurality of irising metal inserts 84 each of which includes upper triangular plate 86, lower triangular plate 88 and stem 90 joining plates 86 and 88. Each of plates 86 include recess 92 extending along the outer portion of one side thereof and facing away from stem 90 and projection 94 extending from the outer edge of its other side. As shown with respect to inserts 54, lower plates 88 may be smaller than upper plates 86. Lower plates 88 have recesses 96 and projections 98 and recesses 96 facing away from stem 90. Projections 94 and 98 engage in recesses 92 and 96 respectively of adjacent plates 86 and 88 as previously explained and ensure that inserts 84 do not fall from their position into the well bore.

What is claimed is:

1. An annular blowout preventer comprising a body having a central bore therethrough and a packer chamber surrounding said central bore, an annular packer positioned in said chamber, and means for moving said annular packer from a relaxed open position radially inward to a position closing said central bore, said annular packer including a resilient annulus, and a plurality of irising metal inserts embedded in said resilient annulus, each of said inserts including an upper plate having a generally triangular shape with a projection extending from one side and a recess on the other side, a lower plate having a generally triangular shape with a projection extending from one side and a recess on the other side, and a stem secured to and extending between said plates, the movement of said inserts being a pivotal movement with their inner ends pivoting inwardly with the closing movement of the resilient annulus, the interengagement of each of said projections in the recess of the adjacent insert plate being maintained so that said inserts remain in said chamber regardless of deterioration of said resilient annulus.

2. An annular blowout preventer according to claim 1 wherein said plates have similar shapes and are oriented similarly for identical irising action.

3. An annular blowout preventer according to claim 1 wherein, 'said recesses are open to the sides of said plates away from said resilient annulus and said projections on adjacent plates are received in said recesses, said recesses having a sufficient length to allow full movement of the inserts with the opening and closing movement of said resilient annulus.

4. An annular blowout preventer according to claim 1 wherein said recesses and projections are positioned to prevent disengagement of the inserts.

5. An annular blowout preventer according to claim 1 wherein the material of said resilient annulus is excluded from said plate recesses.

6. An annular blowout preventer according to claim 5 wherein said recesses face away from said resilient annulus.

7. An annular blowout preventer comprising a body having a central bore therethrough and a packer chamber surrounding said central bore, an annular packer positioned in said chamber, and means for moving said annular packer from a relaxed open position radially inward to a position closing said central bore, said annular packer including a resilient annulus, and a plurality of irising metal inserts embedded in said resilient annulus, each of said inserts including an upper plate having a generally triangular shape with a projection extending from one side and a recess on the other side, a lower plate having a generally triangular shape with a projection extending from one side and a recess on the other side, and a stem connecting between said plates to retain them in general parallel orientation, the projections of each of said inserts engaging in the recess of the next adjacent insert to form an interengaged structure securing the inserts against total disengagement from each other without undue limitation to the irising movement of the inserts as the packer is moved between open and closed positions, the irising movement of said inserts being a pivoting movement with the inner ends with respect to the outer ends with the interengagement of their projections in the adjacent recesses being maintained during all positions of said irising movements.

8. In combination with an annular blowout preventer having a body with a central bore and an annular packer chamber surrounding the bore, means for moving a packer in said chamber radially inward to a position closing the bore, the subcombination of an annular packer including a resilient annulus, and a plurality of metal inserts embedded in said resilient annulus, each of said inserts including an upper triangular shaped plate having a recess along one side and a projection on the other side located so that the projection engages in the recess of the adjacent upper plate, a lower triangular shaped plate having a recess along one side and a projection on the other side located so that the projection engages in the recess of the adjacent lower plate, and a stem secured to an extending between said upper plate and said lower plate, said inserts moving in an irising motion with their inner ends pivoting inwardly when said annular packer is moved to closed position.

9. An annular packer according to claim 8 wherein said recesses face away from said resilient annulus.

10. An annular packer according to claim 8 wherein said recesses extend from a point spaced from the inner end of their inserts to a point past the mid point of the side, and said projections are positioned slightly forward of the mid point of their sides.

11. An annular packer according to claim 8 wherein said recesses extend from a point outward of the mid point of their side to the outer end of their side, and said projections extend from the outer end of their sides.

12. An annular packer according to claim 8 wherein said inserts are integral cast alloy steel.

* * * * *

UNITED STATES PATENT AND TRADEMARK OFFICE

CERTIFICATE OF CORRECTION

PATENT NO. : 4,458,876

DATED : JULY 10, 1984

INVENTOR(S) : GARY R. SCHAEPER & BOLIE C. WILLIAMS III

It is certified that error appears in the above—identified patent and that said Letters Patent is hereby corrected as shown below:

Title page, [73] Assignee: Change "Ventre Corporation, Mt. Clemens, Mich." to - - Cameron Iron Works, Inc., Houston, Texas - -

Title page, Column 2 Attorney, Agent, or Firm: Change "Harness, Dickey, and Pierce" to - - Vinson & Elkins - -

Signed and Sealed this

*Nineteenth* Day of *March 1985*

[SEAL]

*Attest:*

DONALD J. QUIGG

*Attesting Officer*

*Acting Commissioner of Patents and Trademarks*